US005209385A

United States Patent [19]

Ledesma

[11] Patent Number: 5,209,385

[45] Date of Patent: May 11, 1993

[54] SHOPPING BAG KIT

[76] Inventor: Carl J. Ledesma, 121 Philadelphia Ave., Northvale, N.J. 07647

[21] Appl. No.: 751,518

[22] Filed: Aug. 29, 1991

[51] Int. Cl.[5] ..... A45F 3/00

[52] U.S. Cl. ..... 224/224; 224/223; 224/228; 224/245; 383/37; 383/38; 383/39

[58] Field of Search ..... 383/38, 39, 6, 37; 224/223, 224, 226, 227, 228, 242, 245, 267

[56] References Cited

U.S. PATENT DOCUMENTS

| | | | |
|---|---|---|---|
| 3,006,532 | 10/1961 | Fine | 383/6 |
| 3,122,225 | 2/1964 | Ward | 383/37 X |
| 4,287,971 | 9/1981 | Daulet | 224/224 X |
| 4,463,789 | 8/1984 | Leiserson | 383/38 X |
| 4,542,826 | 9/1985 | Adams | 383/38 X |
| 4,756,394 | 7/1988 | Cohen | 383/37 X |
| 5,046,860 | 9/1991 | Brennan | 383/38 |

*Primary Examiner*—Henry J. Recla
*Assistant Examiner*—Casey Jacyna
*Attorney, Agent, or Firm*—Samuelson & Jacob

[57] ABSTRACT

A shopping bag kit includes a carrying case of collapsible material and a plurality of reusable shopping bags folded and rolled up into reinforcing columns placed in compartments within the carrying case for assisting in maintaining the carrying case erect to facilitate carrying the kit and the selective withdrawal and deployment of each shopping bag for use.

8 Claims, 2 Drawing Sheets

SHOPPING BAG KIT

The present invention relates generally to shopping bags and pertains, more specifically, to a kit of shopping bags which facilitates the use and reuse of shopping bags for encouraging conservation and preservation of the ecology.

The widespread use of shopping bags for carrying items purchased in various stores, and especially in markets where numerous items are packaged in bags for carrying the items home, more recently has come under close scrutiny from the standpoint of conservation and preservation of the ecology. Thus, use of the ubiquitous disposable paper bag has been questioned as being responsible for using up valuable resources to manufacture the bags as well as from the standpoint of overburdening the facilities for disposal of the bags. Plastic bags have been suggested as an alternative to paper bags, but even plastic bags use valuable resources and present disposal problems. Accordingly, it would be advantageous to have available a shopping bag system which is effective for marketing purposes and which does not tax resources and disposal facilities, yet is convenient and efficient so as to encourage use.

The present invention provides a shopping bag kit which addresses the problems outlined above and which exhibits several objects and advantages, some of which are summarized as follows: Enables the convenient carrying and deployment of reusable shopping bags for encouraging conservation of resources and alleviating the problem of disposal; provides a compact and effective arrangement for carrying and using shopping bags under marketing conditions; establishes an ecologically sound approach to the needs of shoppers for readily usable shopping bags; enables the use of aesthetically pleasing shopping bags which raise the consciousness of others to the need for conserving resources and reducing disposal problems by employing reusable shopping bags; provides an easily and conveniently used construction for encouraging the use of reusable shopping bags; provides a rugged construction for exemplary service over a relatively long service life; enables relatively inexpensive manufacture in large quantities of uniform high quality.

The above objects and advantages, as well as further objects and advantages, are attained by the present invention which may be described briefly as a shopping bag kit for the compact carrying on the person of a plurality of shopping bags for use and reuse in connection with marketing, the shopping bag kit comprising: a carrying case constructed of a flexible collapsible material and having an interior and divider means for dividing the interior into a plurality of compartments placed laterally adjacent one another and extending longitudinally essentially parallel to one another; and a corresponding plurality of shopping bags, each shopping bag being constructed of a relatively thin, foldable reusable material capable of being folded over upon itself about a generally longitudinal axis to establish a compact reinforcing column when the shopping bag is not in use; the compartments of the carrying case each being essentially complementary to a corresponding reinforcing column for reception of the reinforcing columns within corresponding compartments in the carrying case with the axes of the reinforcing columns aligned longitudinally generally parallel with one another such that the reinforcing columns cooperate with the compartmented carrying case to assist in maintaining the assembled shopping bags and carrying case erect for facilitating carrying the shopping bag kit and the selective withdrawal of each shopping bag for deployment and use.

The invention will be understood more fully, while still further objects and advantages will become apparent, in the following detailed description of a preferred embodiment of the invention illustrated in the accompanying drawing, in which.

Figure 1:
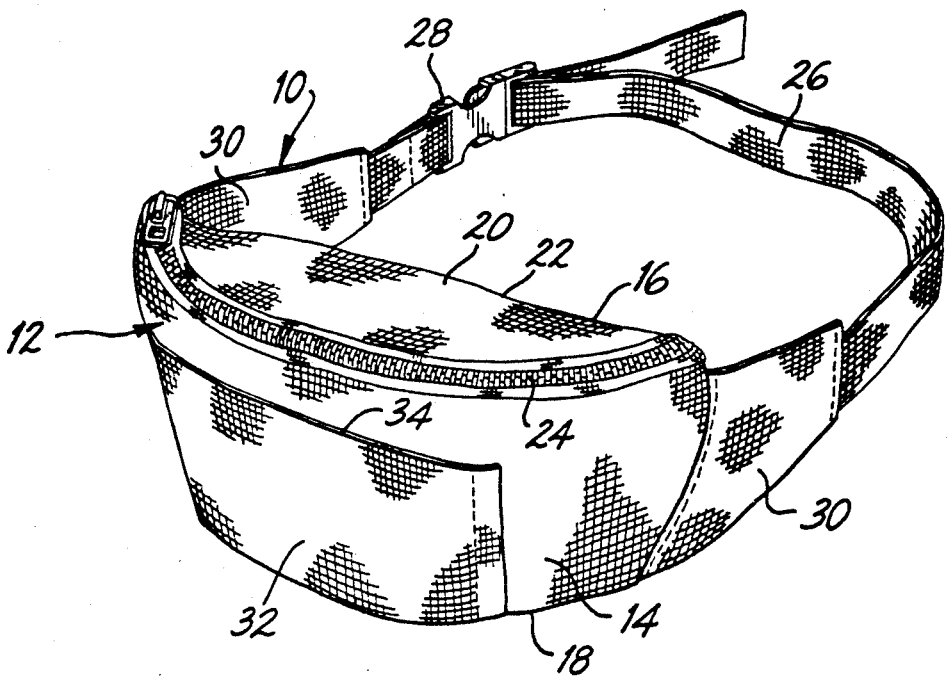
FIG. 1 is a pictorial view of a shopping bag kit constructed in accordance with the present invention.

Referring now to the drawing, and especially to FIG. 1 thereof, a shopping bag kit constructed in accordance with the invention is illustrated generally at 10 and is seen to include a carrying case 12 constructed of a flexible collapsible material, such as a synthetic polymeric textile or a textile which is a blend of natural and synthetic polymeric fibers of the type generally available for personal pouches, handbags and the like. Carrying case 12 has a front panel 14, a rear panel 16, a bottom panel 18 and a top panel 20 constructed in the form of a cover hinged at 22 so as to serve as a closure for the top of the carrying case 12. A slide fastener 24 extends along a portion of the border of the top panel 20 and a corresponding portion of the border of the front panel 14 to complete the closure provided by the top panel 20. A strap 26 having a quick-release buckle 28 is affixed at each end to a strap retainer 30, as by sewing, which strap retainer 30 is integral with the carrying case 12 at the intersection of the front panel 12 and the rear panel 14. Strap 26, together with buckle 28, provides a convenient securing means for securing the carrying case 12 upon the person. An auxiliary panel 32 is affixed to the front panel 14 to establish a front pocket 34.

Figure 2:
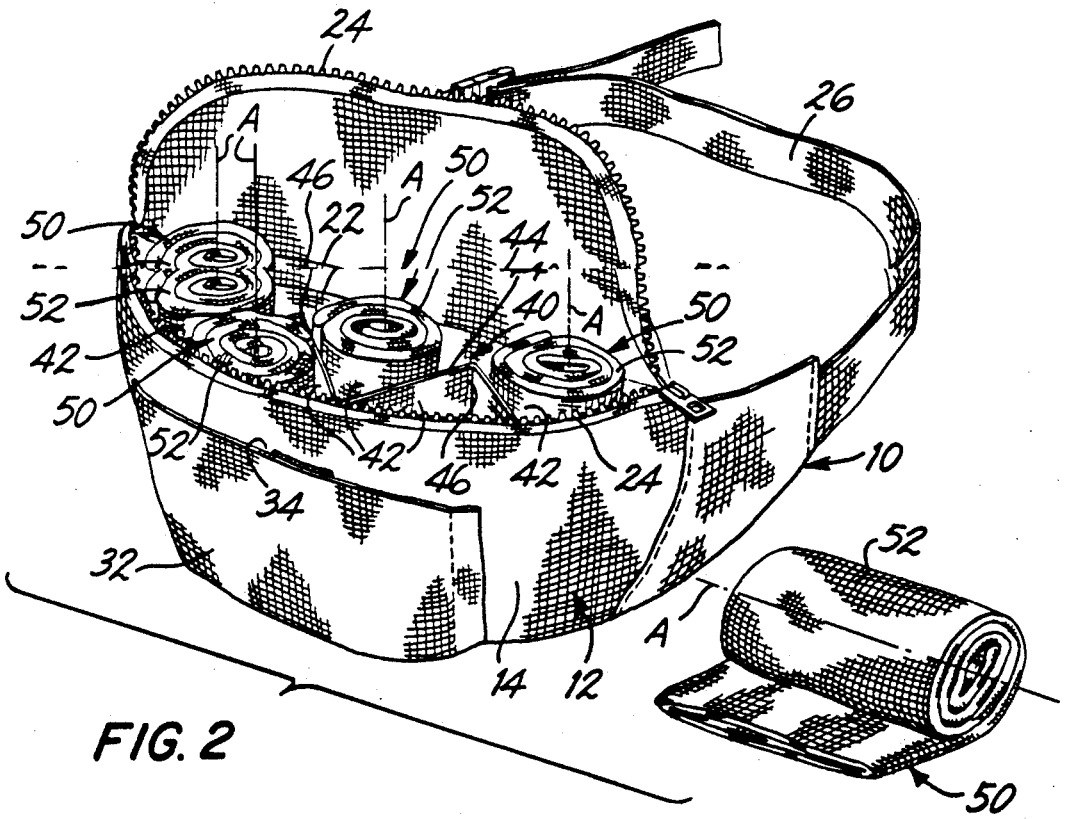
FIG. 2 is a view similar to FIG. 1, but with the carrying case of the kit opened and one shopping bag removed from the carrying case.
Figure 3:
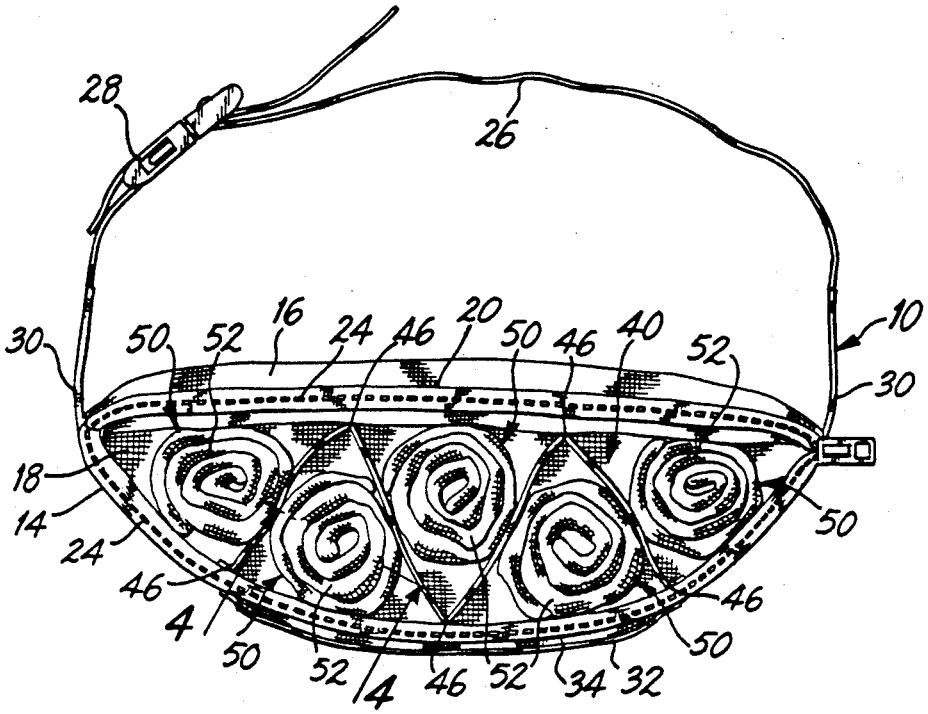
FIG. 3 is a top plan view of the kit, with the carrying case opened to show the interior thereof.
Figure 4:
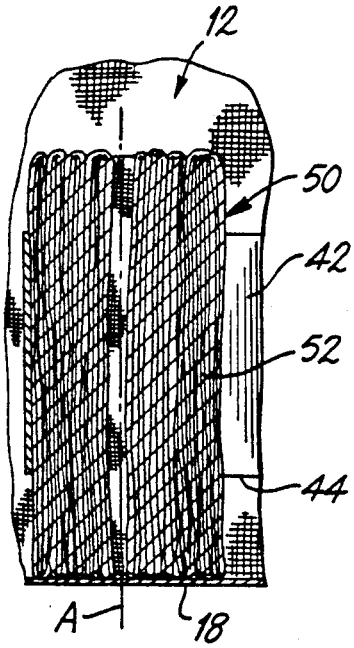
FIG. 4 is a fragmentary cross-sectional view taken along line 4—4 of FIG. 3.

The kit 10 is secured to the person (not shown) in the orientation illustrated in FIGS. 1 and 2. At anytime during use of the kit 10, the slide fastener 24 may be released and the top panel 20 opened, as illustrated in FIGS. 2 and 3, to gain access to the interior 40 of the carrying case 12. The interior 40 is divided by divider means into a plurality of compartments 42 placed laterally adjacent one another in side-by-side relationship and extending longitudinally generally parallel to one another. The divider means is in the form of a web 44 of flexible collapsible material placed between the compartments 42 and affixed along longitudinal regions 46, as by sewing, to the front and rear panels 14 and 16. Web 44 extends from adjacent the bottom panel 18 to adjacent the top panel 20 so that each compartment 42 extends longitudinally from adjacent the bottom panel 18 to adjacent the top panel 20. When the carrying case 12 is in the orientation illustrated in FIGS. 1 and 2, the compartments 42 extend vertically and access to the compartments 42 is from the top of the compartments 42.

A plurality of shopping bags 50 are carried in the carrying case 12, with one shopping bag 50 placed within each compartment 42. As best seen in FIGS. 2 through 5, each shopping bag 50 is constructed of a relatively thin, foldable and reusable material, such as a synthetic polymeric textile material, capable of being folded over upon itself into a compact configuration for fitting into a corresponding compartment 42. The compact configuration is such that when so folded and inserted into a compartment 42 each shopping bag 50 provides a reinforcing column for assisting in maintaining the carrying case 12 erect and properly placed upon the person. In the preferred arrangement, each shopping bag 50 is folded and rolled up upon itself about a generally central longitudinal axis A to establish a cylindrical roll 52. Upon insertion of the shopping bags 50 into the corresponding respective compartments 42, the axes A of the cylindrical rolls 52 are essentially parallel with one another and are aligned generally longitudinally, in the vertical direction. In this manner, the cylindrical rolls 52 provide sufficient reinforcement to assist in maintaining the assembled shopping bags 50 and carrying case 12 erect for facilitating carrying the assembled kit and selective withdrawal of each shopping bag 50 for deployment and use. Thus, the flexible collapsible nature of the material of the carrying case 12 provides comfort and convenience in the use of the kit 10, while the reinforcement provided by the folded and rolled shopping bags 50 facilitates that use.

Figure 5:
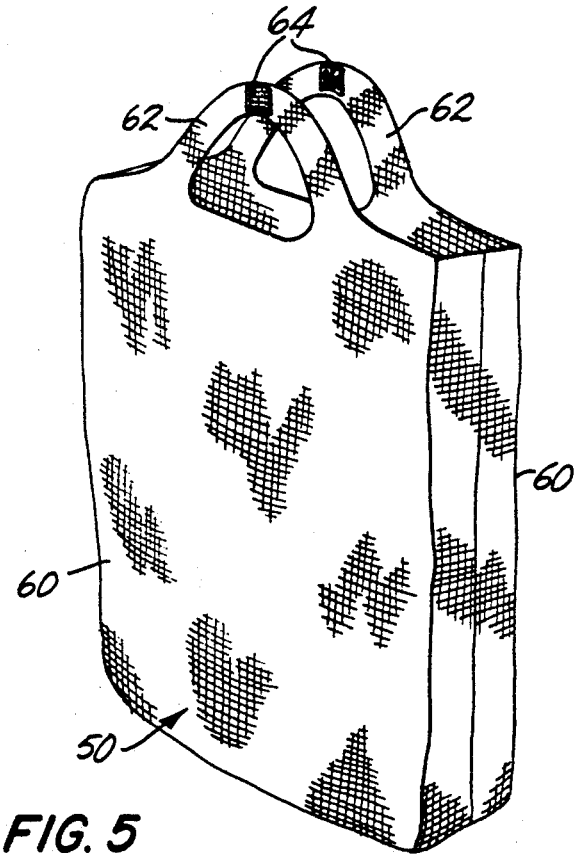
FIG. 5 is a pictorial view of a shopping bag of the kit, removed from the carrying case and unfolded for use.

Once a shopping bag 50 is withdrawn from its compartment 42, the shopping bag 50 is opened easily and made ready for use, as seen in FIG. 5. The shopping bag 50 includes side walls 60 of thin but rugged material, such as a nylon textile material, having a capacity for containing a selection of goods purchased during marketing. Carrying handles 62 are integral with the side walls 60 and preferably include a fastener 64 in the form of strips of hook-and-loop materials, known as VELCRO, for closing the top end of the shopping bag 50 and for facilitating carrying of the shopping bag 50. The kit 10 makes it possible for a shopper to carry a sufficient number of shopping bags 50 for marketing purposes in a compact and convenient form so as to encourage the use of reusable shopping bags 50 in place of the paper or plastic bags usually provided in the marketplace. Once the shopping bags 50 which have been used are emptied, the emptied shopping bags 50 may be folded and rolled and replaced within the respective compartments 42 for reuse.

Shopping bag kit 10 provides an aesthetically pleasing appearance, as well as a convenient and compact arrangement for carrying all of the shopping bags 50 which may be needed for a particular shopping expedition. The front pocket 34 provides a handy means for carrying coupons and the like used in connection with marketing. In all, the shopping bag kit 10 encourages the use and reuse of shopping bags 50 in place of disposable shopping bags and thus assists conservation and helps alleviate disposal problems. It will be seen that shopping bag kit 10 attains the objects and advantages summarized above; namely, enables the convenient carrying and deployment of reusable shopping bags for encouraging conservation of resources and alleviating the problem of disposal; provides a compact and effective arrangement for carrying and using shopping bags under marketing conditions; establishes an ecologically sound approach to the needs of shoppers for readily usable shopping bags; enables the use of aesthetically pleasing shopping bags which raise the consciousness of others to the need for conserving resources and reducing disposal problems by employing reusable shopping bags; provides an easily and conveniently used construction for encouraging the use of reusable shopping bags; provides a rugged construction for exemplary service over a relatively long service life; enables relatively inexpensive manufacture in large quantities of uniform high quality.

It is to be understood that the above detailed description of the preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A shopping bag kit for the compact carrying on the person of a plurality of shopping bags for use and reuse in connection with marketing, the shopping bag kit comprising:

a compact carrying case constructed of a flexible collapsible material and having an interior and divider means for dividing the interior into a plurality of compartments placed laterally adjacent one another and extending longitudinally essentially parallel to one another throughout the interior;

a corresponding plurality of shopping bags, each shopping bag being constructed of a relatively thin, foldable reusable material capable of being folded over upon itself about a generally longitudinal axis to establish a compact reinforcing column when the shopping bag is not in use; and securing means including a strap affixed to the carrying case for extending horizontally around the person so as to selectively secure the carrying case upon the person with the axes of the reinforcing columns oriented in the vertical direction said strap being the sole securing means so as to provide ready access to the compartments of the carrying case from vertically above the compartments when the carrying case is secured upon the person;

the compartments of the carrying case each being essentially complementary to a corresponding reinforcing column for reception of the reinforcing columns within corresponding compartments in the carrying case with the axes of the reinforcing columns aligned longitudinally generally parallel with one another such that the reinforcing columns cooperate with the compartmented carrying case to assist in maintaining the assembled shopping bags and carrying case erect for facilitating carrying the shopping bag kit and the selective withdrawal of each shopping bag for deployment and use with the carrying case secured upon the person such that removal of the carrying case from the person is unnecessary to accomplish said selective withdrawal of the shopping bags from the carrying case.

2. The invention of claim 1 wherein the divider means includes a web of collapsible material between adjacent compartments, the web being affixed along longitudinal regions to the material of the carrying case such that the web and the compartments extend longitudinally within the interior of the carrying bag and are maintained erect by the reinforcing columns placed within the compartments.

3. The invention of claim 2 wherein the carrying case includes a bottom and a top spaced longitudinally from the bottom, and the web extends from adjacent the bottom to adjacent the top such that each compartment extends longitudinally from adjacent the bottom to adjacent the top of the carrying case.

4. The invention of claim 3 wherein the carrying case includes a closure at the top of the carrying case for selectively closing and opening access to the interior of the carrying case.

5. The invention of claim 1 wherein the material of each shopping bag is capable of being rolled up upon itself about the longitudinal axis such that the reinforcing column is a cylindrical roll and the longitudinal axis extends generally along the central axis of the cylindrical roll.

6. The invention of claim 5 wherein the divider means includes a web of collapsible material between adjacent compartments, the web being affixed along longitudinal regions to the material of the carrying case such that the web and the compartments extend longitudinally within the interior of the carrying bag and are maintained erect by the cylindrical rolls placed within the compartments.

7. The invention of claim 6 wherein the carrying case includes a bottom and a top spaced longitudinally from the bottom, and the web extends from adjacent the bottom to adjacent the top such that each compartment extends longitudinally from adjacent the bottom to adjacent the top of the carrying case.

8. The invention of claim 7 wherein the carrying case includes a closure at the top of the carrying case for selectively closing and opening access to the interior of the carrying case.

* * * * *